US005957106A

United States Patent [19]

Maloney et al.

[11] Patent Number: 5,957,106

[45] Date of Patent: Sep. 28, 1999

[54] ENGINE HAVING AN INTAKE/EXHAUST VALVE INTEGRATED WITH A FUEL INJECTOR

[75] Inventors: Ronald P. Maloney, Peoria; Charles R. Miller, Metamora, both of Ill.

[73] Assignee: Caterpillar Inc., Peoria, Ill.

[21] Appl. No.: 08/958,659

[22] Filed: Oct. 29, 1997

[51] Int. Cl.[6] ..... F02M 57/04; F01L 1/28

[52] U.S. Cl. ..... 123/296; 123/79 R

[58] Field of Search ..... 123/79 R, 90.12, 123/296

[56] References Cited

U.S. PATENT DOCUMENTS

| | | | |
|---|---|---|---|
| 2,044,522 | 6/1936 | Wurtele | 123/296 |
| 2,071,719 | 2/1937 | Wurtele | 123/296 |
| 2,072,437 | 3/1937 | Wurtele | 123/90.12 |
| 2,082,583 | 6/1937 | Stoikowitz | 123/79 C |
| 2,125,213 | 7/1938 | Anderson | 123/188.8 |
| 2,280,386 | 4/1942 | Dickson | 123/296 |
| 3,590,791 | 7/1971 | Roosa | 123/79 R |
| 3,682,152 | 8/1972 | Muller-Berner | 123/90.11 |
| 3,812,829 | 5/1974 | McCormick | 123/296 |
| 4,020,803 | 5/1977 | Thuren et al. | 123/275 |
| 4,058,091 | 11/1977 | Tanahashi | 123/261 |
| 4,408,574 | 10/1983 | Schaich | 123/26 |
| 4,503,817 | 3/1985 | Klomp et al. | 123/79 R |
| 4,674,450 | 6/1987 | Krajancich | 123/79 A |
| 4,809,655 | 3/1989 | Mahler | 123/296 |
| 5,522,358 | 6/1996 | Clarke | 123/296 |
| 5,697,342 | 12/1997 | Anderson et al. | 123/446 |

FOREIGN PATENT DOCUMENTS 198761 6/1923 United Kingdom .

OTHER PUBLICATIONS

ADD, Inc., ADD30V, 16 pages Parallel Japanese and English text, Publication date and location unknown.

ADD, Inc., Advanced Design Medium–Speed Engine Announced By ADD, pp. 16, 18–19 of Diesel and Gas Turbine Worldwide, Mar., 1996.

Advanced Diesel Engine Development 10 pages, Japanese with some English Translation, Published in Japan, date unknown.

M. Schecter and M. Levin, Camless Engine, pp. 17–31, Published in 1996 by Society of Automotive Engineers, Inc., doc. No. 960581.

*Primary Examiner*—Tony M. Argenbright
*Attorney, Agent, or Firm*—Michael McNeil

[57] ABSTRACT

A fuel injection system includes a hydraulically-actuated electronically-controlled fuel injector having a needle valve member and an injector body that defines a fuel pressurization chamber that opens to a nozzle outlet. The needle valve member is positioned in the injector body and is moveable between an inject position at which the nozzle outlet is open, and a blocked position at which the nozzle outlet is blocked. A portion of the injector body adjacent the nozzle outlet is a mono gas valve member. The movement of the gas valve member controls one or both of the intake and exhaust portions of the engine cycle. The gas valve member is also hydraulically-actuated and electronically-controlled by the same hydraulic actuator that operates the fuel injector.

20 Claims, 7 Drawing Sheets

16
52
17
14
15

61
59
53
16
51
52
17
55
80
84
19
14
15

ENGINE HAVING AN INTAKE/EXHAUST VALVE INTEGRATED WITH A FUEL INJECTOR

TECHNICAL FIELD

The present invention relates generally to fuel injectors and intake/exhaust valves for engines, and more particularly to an electronically-controlled intake/exhaust valve integrated with a fuel injector.

BACKGROUND ART

Engineers are constantly looking for ways to improve the efficiency and performance of internal combustion engines. Several conflicting demands on some engines have placed undesirable spacial limitations relating to the intake and exhaust valve(s) as well as the incorporation of a suitable fuel injection system. In many diesel type engines, four gas exchange valves (two intake and two exhaust) surround a centrally mounted fuel injector whose tip protrudes directly into the hollow piston cylinder. Because manufacturing constraints generally restrict each of the valves and fuel injectors to a circular cross section, the size of these components is limited by each other and the size of the piston for a given engine. These spacial constraints often result in compromises between the valves and fuel injector that result in an engine with less efficiency and lower performance levels than should otherwise be possible.

In many engines, both the gas exchange valve(s) and the fuel injection system are coupled in their operation to the crank shaft angle of the engine. In other words, in many engines these components are driven to operate by a rotating cam that is driven to rotate directly by the engine. Engineers have recognized that combustion efficiency and overall engine performance can be improved by de-coupling the operation of the fuel injection system from the rotation angle of the engine. In this regard, Caterpillar, Inc. of Peoria, Ill. has seen considerable success by incorporating hydraulically-actuated electronically-controlled fuel injectors into engines. These fuel injection systems allow an engine computer to inject a calculated amount of fuel, often in a pre-determined way, into the combustion space in a timing that is based upon sensed operating conditions and other parameters.

In part because of the gains observed by the incorporation of hydraulically-actuated electronically-controlled fuel injectors, engineers believe that further improvements in performance and efficiency can be gained by also de-coupling the gas exchange valves from the engine rotation angle. In other words, it is also desirable that the gas exchange valves be electronically-controlled in order to control exhaust and intake portions of the engine cycle independent of the engine crank shaft angle. This could allow the intake and exhaust portions of the engine cycle to be optimized for a particular operating condition and other parameters, such as temperatures and pressures, etc.

The present invention is directed to overcoming these and other problems, as well as improving the efficiency and performance of engines in general.

DISCLOSURE OF THE INVENTION

In one embodiment, the present invention is an engine having an engine casing defining a hollow piston cavity separated from a gas passageway by a valve seat. A gas valve member is moveable between an open position in which a portion is away from the valve seat, and a closed position in which the portion is seated against the valve seat. The gas valve member defines a nozzle outlet, which opens directly into the hollow piston cavity. A needle valve member is positioned in the nozzle chamber and is moveable between an inject position at which the nozzle chamber is open to the nozzle outlet, and a blocked position at which the nozzle chamber is blocked to the nozzle outlet.

In another embodiment, a fuel injection system includes a fuel injector having a needle valve member, an actuator and an injector body that defines a fuel pressurization chamber that opens to a nozzle outlet. A needle valve member is positioned in the injector body and moveable between an inject position at which the fuel pressurization chamber is open to the nozzle outlet, and a blocked position at which the fuel pressurization chamber is blocked to the nozzle outlet. A portion of the injector body adjacent the nozzle outlet is a gas valve member.

In still another embodiment of the present invention, an integrated fuel injector and cylinder valve for an engine includes an injector body that defines an actuation fluid cavity, an actuation fluid inlet, a fuel pressurization chamber and a nozzle outlet. A portion of the injector body is a gas valve member that is moveable with respect to a remaining portion of the injector body between an open position and a closed position. The gas valve member has an opening pressure face exposed to fluid pressure within the injector body and a closing pressure surface exposed to fluid pressure outside the injector body. A needle valve member is positioned in the injector body and is moveable between an inject position at which the fuel pressurization chamber is open to the nozzle outlet, and a blocked position at which the fuel pressurization chamber is blocked to the nozzle outlet. A control valve is attached to the injector body and has a first position at which the actuation fluid inlet is open to the actuation fluid cavity, and a second position at which the actuation fluid inlet is closed to the actuation fluid cavity.

BEST MODE FOR CARRYING OUT THE INVENTION

Figure 1:
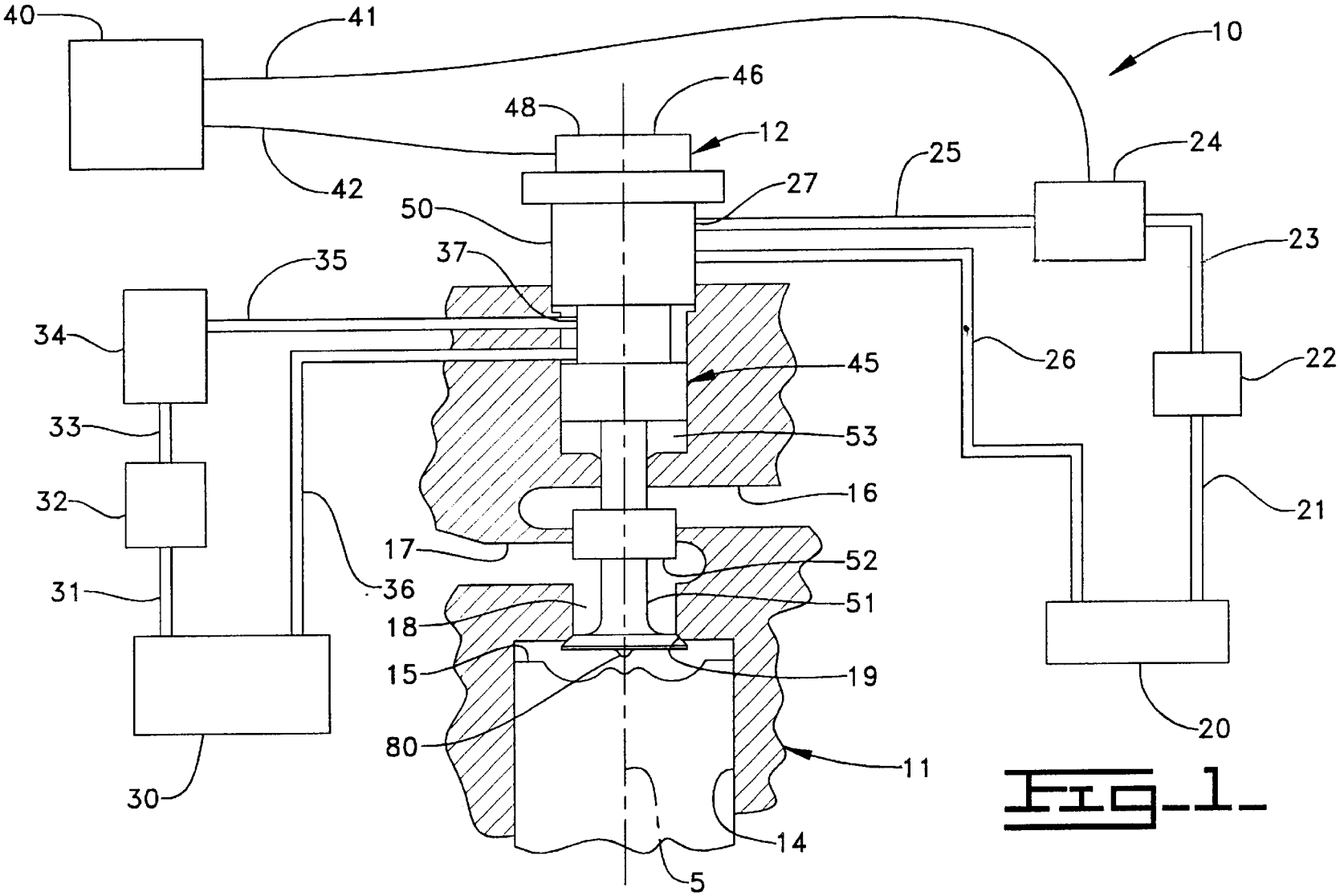
FIG. 1 is a schematic view of an engine and fuel injection system according to one embodiment of the present invention.
Figure 2A:
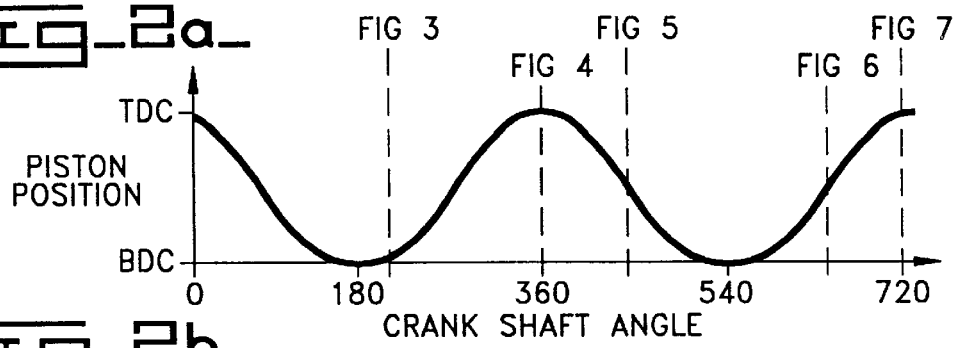
FIGS. 2*a–e* show various parameters including piston position, gas valve member position, needle valve member position, gas control valve member position and solenoid, respectively, versus crank shaft angle for a single engine cycle according to one example aspect of the present invention.
Figure 2B:
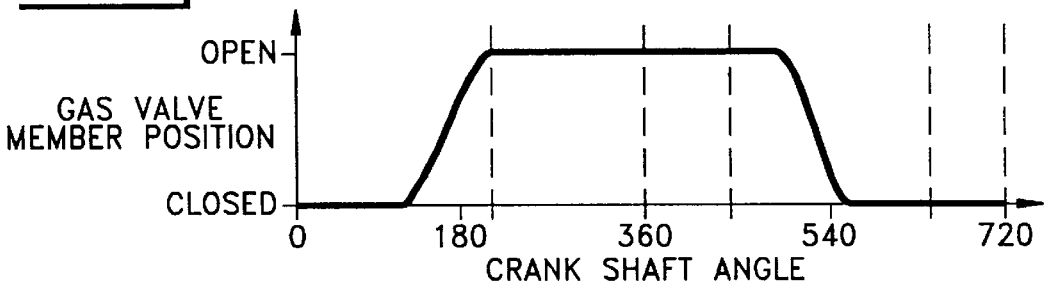
Figure 2C:
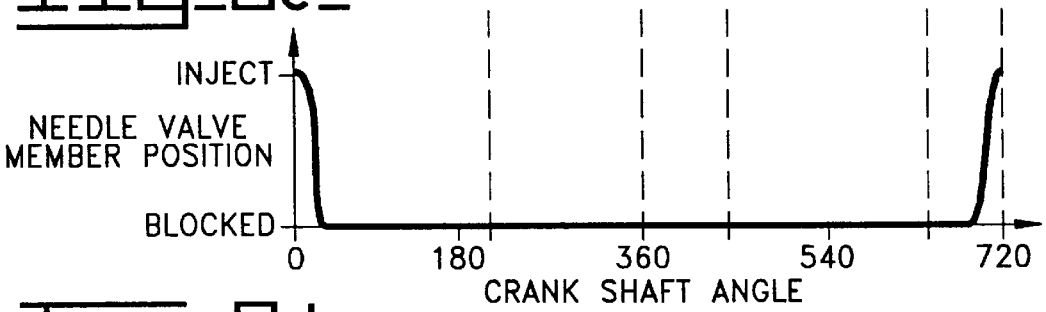
Figure 2D:
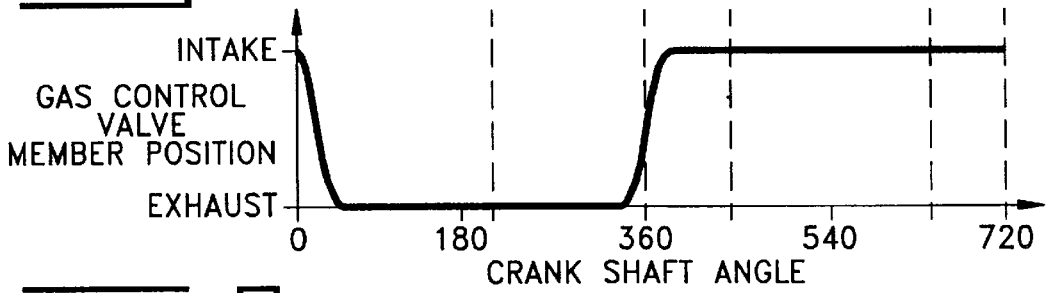
Figure 2E:
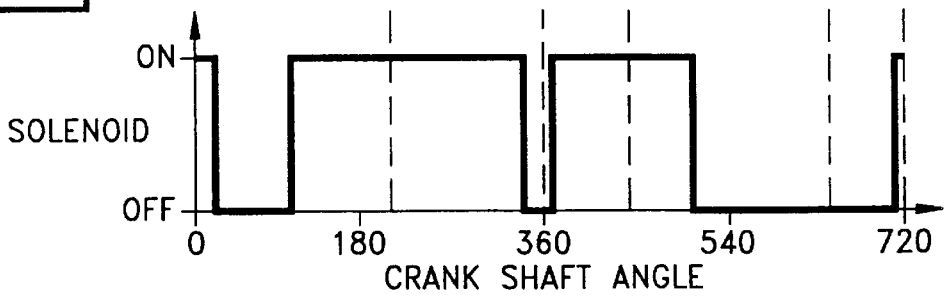

Referring now to FIG. 1, an engine 10 includes an integrated fuel injector and cylinder valve 12 mounted in an engine casing 11. In this example embodiment, engine 10 is adapted as a four stroke diesel type engine. Engine casing 11 defines a cylindrically shaped hollow piston cavity 14 separated from a gas passageway 18 by a valve seat 19. Gas passageway 18 branches in one direction into an exhaust passage 16 and in an other direction into an intake passage 17. As in a conventional engine, a piston 15 is positioned in hollow piston cavity 14 and is moveable by a crank shaft (not shown) between a bottom dead center position and a top dead center position, as shown. Integrated fuel injector and cylinder valve 12, hollow piston cylinder 14 and piston 15 all share a common centerline 5.

Integrated fuel injector and cylinder valve 12 utilizes a hydraulic actuator 46, which is preferably activated by a single solenoid 48, to control and power fuel injector 45 as well as the movement of mono gas valve member 51. Mono gas valve member 51 is a portion of injector body 50, and moves with respect to a remaining portion of injector body 50 to open and close hollow cylinder cavity 14 to gas passageway 18 across valve seat 19. Fuel is supplied to integrated fuel injector and cylinder valve 12 at a fuel inlet 37, and a relatively high pressure actuation fluid, such as engine lubricating oil, is supplied to hydraulic actuator 46 at actuation fluid inlet 27. Solenoid 48 is attached to a control valve within integrated fuel injector and cylinder valve 12 and is the means by which actuation fluid inlet 27 is opened and closed. In turn, the activation of solenoid 48 is controlled by a conventional electronic control module 40 via a communication line 42.

Actuation fluid inlet 27 receives relatively high pressure actuation fluid via supply passage 25, which is connected to a high pressure pump 24. A relatively low pressure circulation pump 22 draws low pressure actuation fluid from reservoir 20, into circulation passage 21 and on to high pressure pump 24 via actuation fluid supply passage 23. Electronic control module 40 controls the magnitude of the actuation fluid pressure by controlling high pressure pump 24 via communication line 41. By controlling the pressure of the actuation fluid, an additional element of control over the integrated fuel injector and cylinder valve 12 is gained. After doing work within hydraulic actuator 46, actuation fluid is returned to reservoir 20 via an actuation fluid return passage 26. Those skilled in the art will appreciate that any available fluid could be used to power hydraulic actuator 46, including but not limited to lubricating oil, fuel fluid, coolant fluid, etc.

Fuel is supplied to fuel injector 45 via a fuel supply passage 35 that is connected at one end to fuel inlet 37 and on its other end to a fuel circulation pump 34. Fuel circulation pump 34 draws fuel from fuel tank 30, along fuel circulation passage 31, through fuel filters 32 and eventually into pump 34 via fuel supply passage 33. Any fuel not used during the regular operating cycle of integrated fuel injector control valve 12 is recirculated to fuel tank 30 via fuel return passage 36.

Figure 3:
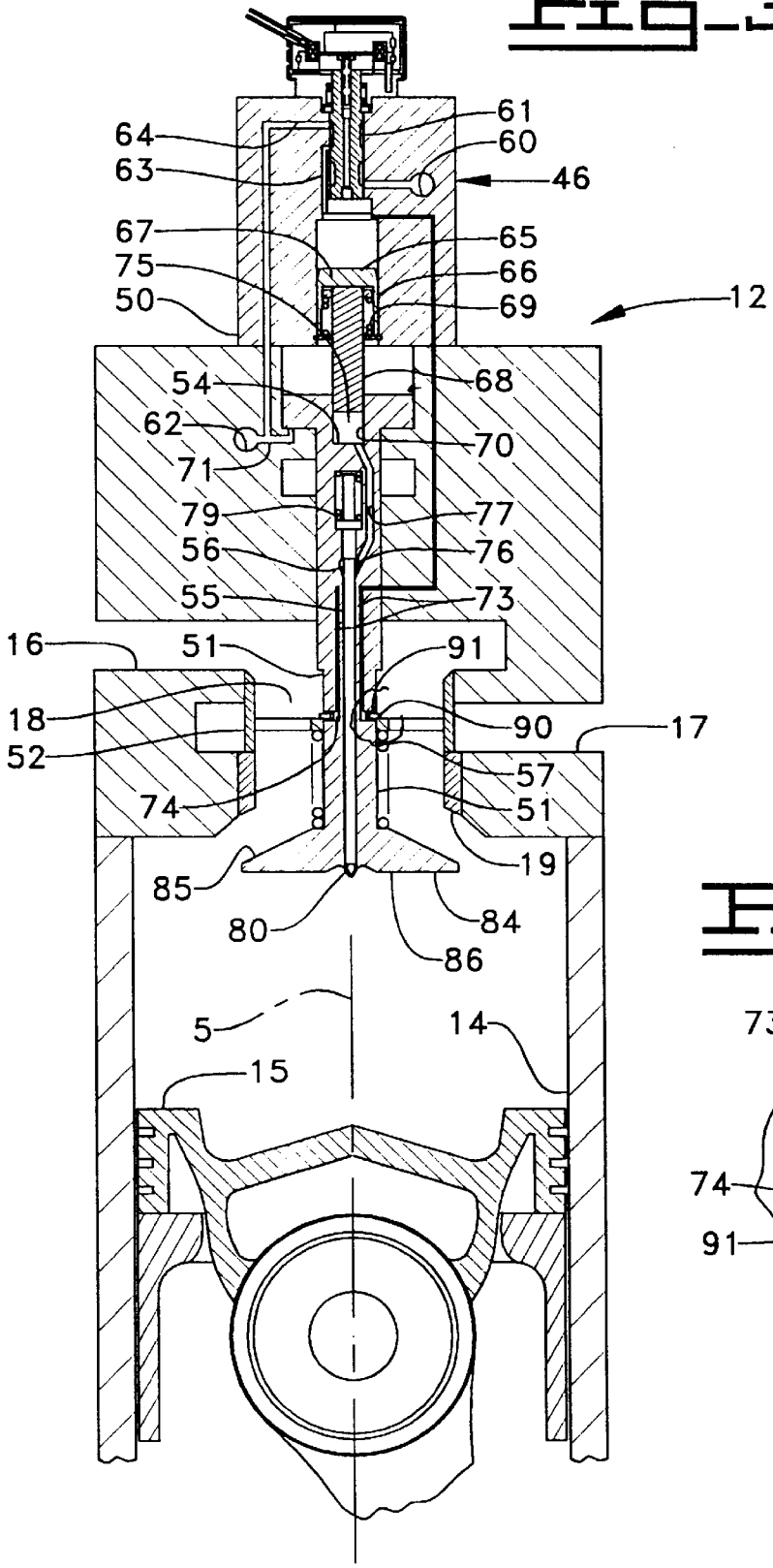
FIG. 3 is a diagrammatic partial sectioned side elevational view of an engine and fuel injection system according to the present invention when in an exhaust portion of an engine cycle.
Figure 3A:
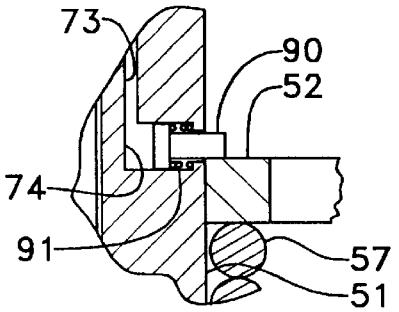
FIG. 3*a* is an enlarged diagrammatic partial section view of a mechanism used for actuating the gas control valve according to one aspect of the present invention.

Referring now in addition to FIGS. 3 and 3*a*, the internal structure of integrated fuel injector and control valve 12 is illustrated. In particular, when gas valve member 51 is in its open position as shown in FIG. 3, the up or down positioning of gas control valve member 52 determines whether hollow piston cavity 14 is connected either to exhaust passage 16 or intake passage 17 via gas passageway 18. Gas control valve member 52 is shown moved downward to its exhaust position in FIG. 3. Although the movement of gas control valve 52 could be accomplished in a number of ways known in the art, in this embodiment gas control valve member 52 is biased toward its exhaust position by a compression spring 57. However, when gas valve member 51 is moving to its open position, high pressure oil flows into gas control activation cavity 74 via gas control connection passage 73. This high pressure acts on one side of catch pin 90 pushing the same radially outward against the action of catch biasing spring 91. When catch(es) 90 are pushed outward as shown in FIG. 3*a*, they are capable of coming in contact with gas control valve member 52 such that both members move downward together. In this embodiment, the travel distance of gas control valve member 52 from its intake to its exhaust position is about the same as the travel distance of gas valve member 52 from its closed position to its open position. Although not readily apparent, gas control valve member 52 has a cylindrical outer wall connected to an internal sliding member via a plurality of spoke members. This allows gases to pass between the outer surface of gas valve member 51 and the outer cylindrical wall of gas control valve member 52.

As in a conventional inwardly opening valve system, valve portion 86 of gas valve member 51 is positioned in hollow piston cavity 14. During combustion and injection events, valve contact surface 85 is held in contact with valve seat 19 to isolate the combustion space from gas passageway 18. Also as in a conventional valving system, compression and combustion pressure acting on closing pressure surface 84 of gas valve member 51 serves to hold the same closed during compression and combustion events. Gas valve member 51 is normally biased towards a closed position by pressurized fluid acting on gas valve return shoulder 59 (FIGS. 6 and 7) that is positioned within gas valve biasing chamber 53 (FIGS. 1, 6 and 7).

The remaining portions of the internal structure of integrated fuel injector and control valve 12 are substantially similar to hydraulically-actuated electronically-controlled fuel injectors of the type manufactured by Caterpillar, Inc. of Peoria, Ill. and described in detail in numerous issued patents. Nevertheless, injector body 50 includes an actuation fluid inlet conduit 60 that opens on one end to the actuation fluid inlet 27 shown in FIG. 1. A solenoid actuated control valve 61 is positioned between the actuation fluid inlet conduit 60 and actuation fluid cavity 65. Solenoid actuated control valve 61 is attached to and moved by solenoid 48, which is shown in FIG. 1. When the solenoid is activated, control valve 61 moves to a first position in which activation fluid inlet conduit 60 is open to actuation fluid cavity 65 via connection passage 63. Control valve 61 is normally biased to a second position via any conventional means, such as a spring (not shown) such that actuation fluid cavity 65 is connected to drain passage 62 via connection passages 63 and 64. Referring back in addition to FIG. 1, drain passage 62 is connected on the outer surface of injector body 50 to the actuation fluid return passage 26.

Figure 6:
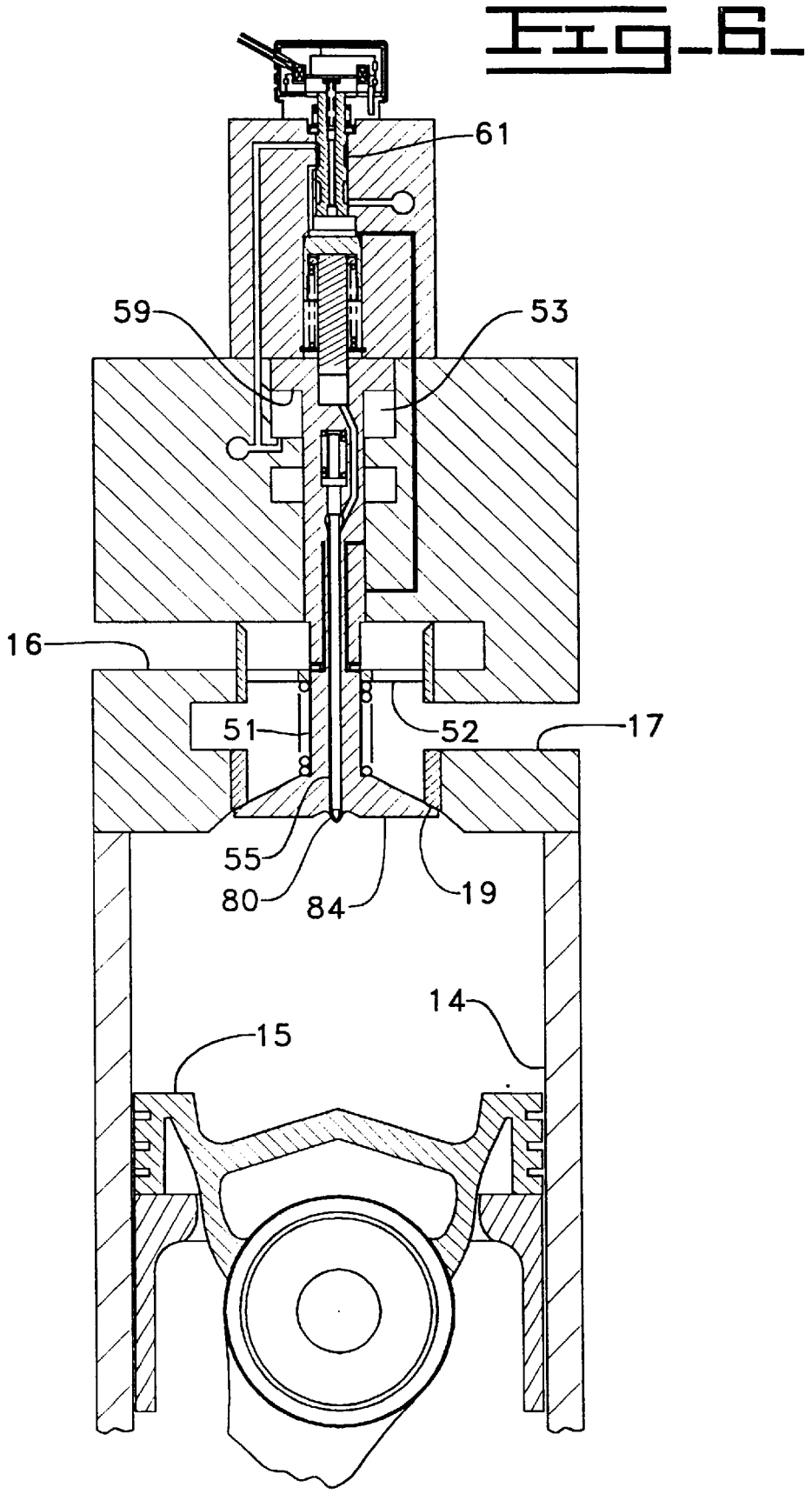
FIG. 6 is a view similar to FIGS. 3–5 except showing the engine and fuel injection system in the compression portion of the engine cycle.
Figure 7:
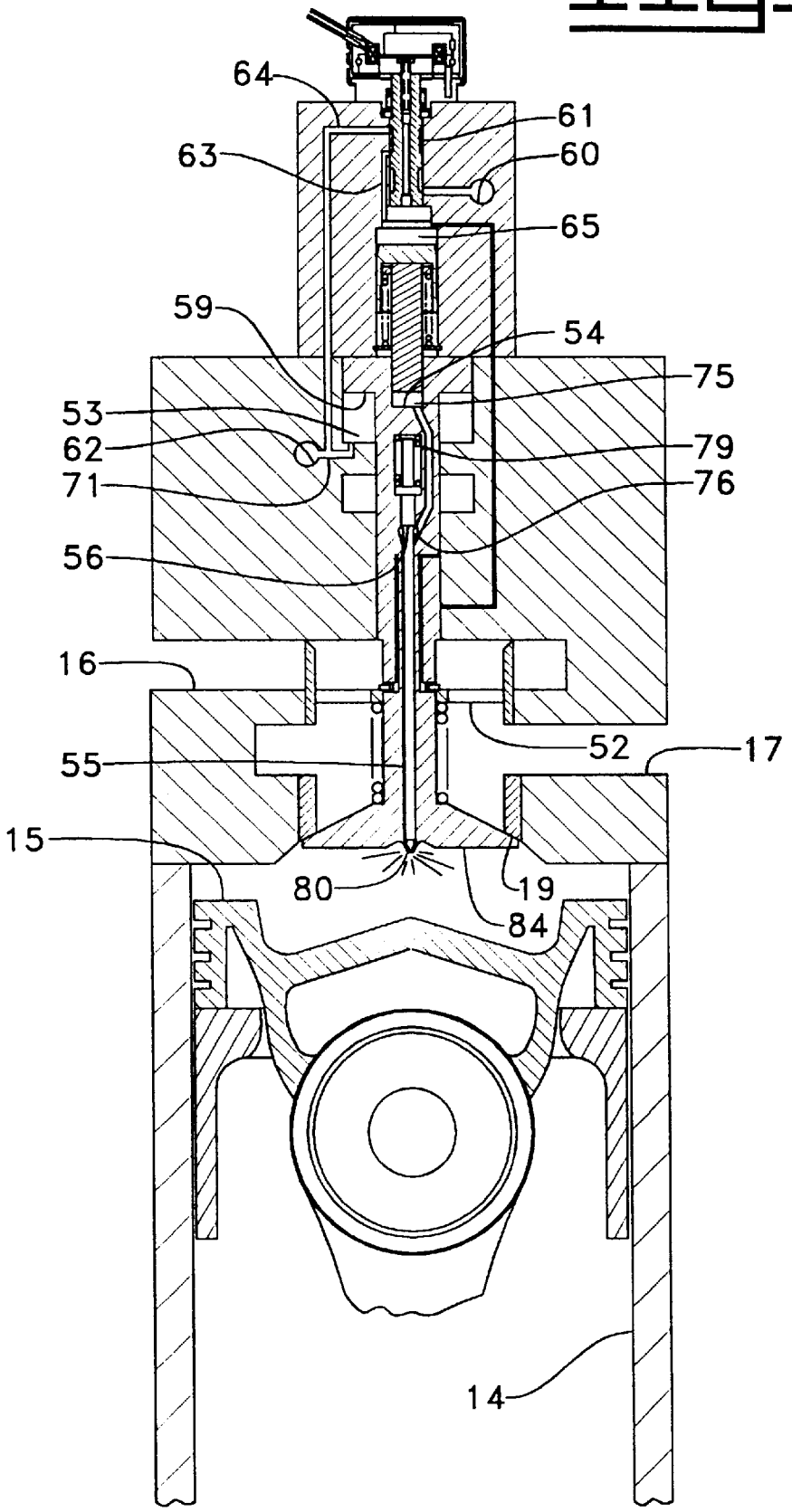
FIG. 7 is a view similar to FIGS. 3–6 showing the engine and fuel injection system are in the injection portion of the engine cycle.

An intensifier piston 66 is positioned in actuation fluid cavity 65 and is moveable between a retracted position as shown in FIG. 6 and an advanced position as shown in FIG. 3. Intensifier piston 66 includes a top hydraulic surface 67 that is acted upon by the fluid pressure existing within actuation fluid cavity 65. Actuation fluid control valve 61 along with actuation fluid cavity 65 and intensifier piston 66, as well as the associated passageways, constitute the hydraulic actuator 46 according to the present invention.

Gas valve member 51 includes a plunger bore 70, within which a plunger 68 reciprocates between an advanced position and a retracted position. Plunger 68 is connected to the underside of intensifier piston 66 such that both are biased toward their respective retracted positions by a return spring 69. The bottom of plunger bore 70 is an opening pressure surface 54 for gas valve member 51. Opening pressure surface 54 is sized in relation to closing pressure surface 84 such that gas valve member 51 will move to its open position as shown in FIG. 3 when fuel pressure acting on opening pressure surface 54 is sufficient to overcome any counter force resulting from gas pressure acting on closing pressure surface 84 within hollow piston cavity 14. These two pressure surfaces are sized such that gas valve member 51 can only move to its open position when pressure within hollow piston cavity 14 is relatively low. When pressure within hollow piston cavity is at its relatively high compression or even higher combustion pressures, the surfaces sized such that it cannot produce a sufficient pressure force on opening pressure surface 54 to move gas valve member 51 to its open position. As stated earlier, gas valve member 51 is only biased toward its closed position by the relatively low pressure existing in drain passage 62, which is connected to gas valve biasing chamber 53 via a biasing connection passage 71. It is important to note that the travel distance of piston 66 from its retracted position to its advanced position is such that it is in contact with its bottom stop when gas valve member 51 is in its open position. This travel distance prevents further movement of intensifier piston 66 so that no fuel is accidentally injected into hollow piston cylinder 14 when gas valve member 51 is in its open position.

When the gas pressure within hollow piston cavity 14 that is acting upon closing pressure surface 84 is sufficient to hold gas valve member 51 closed, the remaining portions of integrated fuel injector and control valve 12 behaves essentially as a hydraulically-actuated fuel injector. In particular, plunger 68, plunger bore 70 and opening pressure surface 54 all define a fuel pressurization chamber 75 that is connected to a nozzle chamber 76 via a nozzle supply passage 77. In turn, nozzle chamber 76 is open to nozzle outlet 80, which opens directly into hollow piston cylinder 14. It is important to note that nozzle outlet 80 is positioned at the approximate center of valve portion 86 and opens directly into hollow piston cavity 14.

A needle valve member 55 is positioned within gas valve member 51 and is moveable between an inject position in which nozzle chamber 76 is open to nozzle outlet 80, and a blocked position in which nozzle chamber 76 is blocked to nozzle outlet 80. Needle valve member 55 is normally biased toward its blocked position by a needle return spring 79, but is capable of moving to its inject position when fuel pressure acting on lifting hydraulic surface 56 reaches a valve opening pressure sufficient to overcome needle return spring 79. As in a conventional fuel injector, the valve opening pressure is between a relatively low fuel supply pressure and a relatively high injection pressure. It is important to note that the magnitude of fuel pressure necessary to move gas valve member 51 to its open position is significantly lower than the valve opening pressure necessary to lift needle valve member 55 to its inject position. Thus, opening pressure surface 54, closing pressure surface 84 and lifting hydraulic surface 56 are all sized relative to one another, and appropriate travel distances of the components are defined such that: (1) fuel is not injected into hollow piston cavity 14 when gas valve member 51 is in its open position; (2) only one of either the gas valve member 51 or the needle valve member 55 are moved when hydraulic actuator 46 is activated; (3) gas valve member 51 remains closed when pressure in hollow piston cavity 14 is relatively high during compression and combustion; and (4) needle valve member 55 is capable of being lifted to its inject position only when gas valve member 51 is held in its closed position by high pressure within hollow piston cavity 14.

Industrial Applicability

Referring now to FIGS. 2–7, the operation of engine 10 is illustrated for a single four stroke diesel type engine cycle. The vertical dotted lines on FIGS. 2*a–e* illustrate where the snapshot illustrations of FIGS. 3–7 are taken during the engine cycle. FIG. 3 shows the engine when piston 15 is about at its bottom dead center position and pressure within hollow piston cavity 14 is relatively low. At the same time the solenoid is energized such that gas valve member 51 has been moved to its open position, and gas control valve member 52 has been moved downward to its exhaust position such that hollow piston cavity 14 is open to exhaust passage 16 via gas passageway 18.

Figure 4:
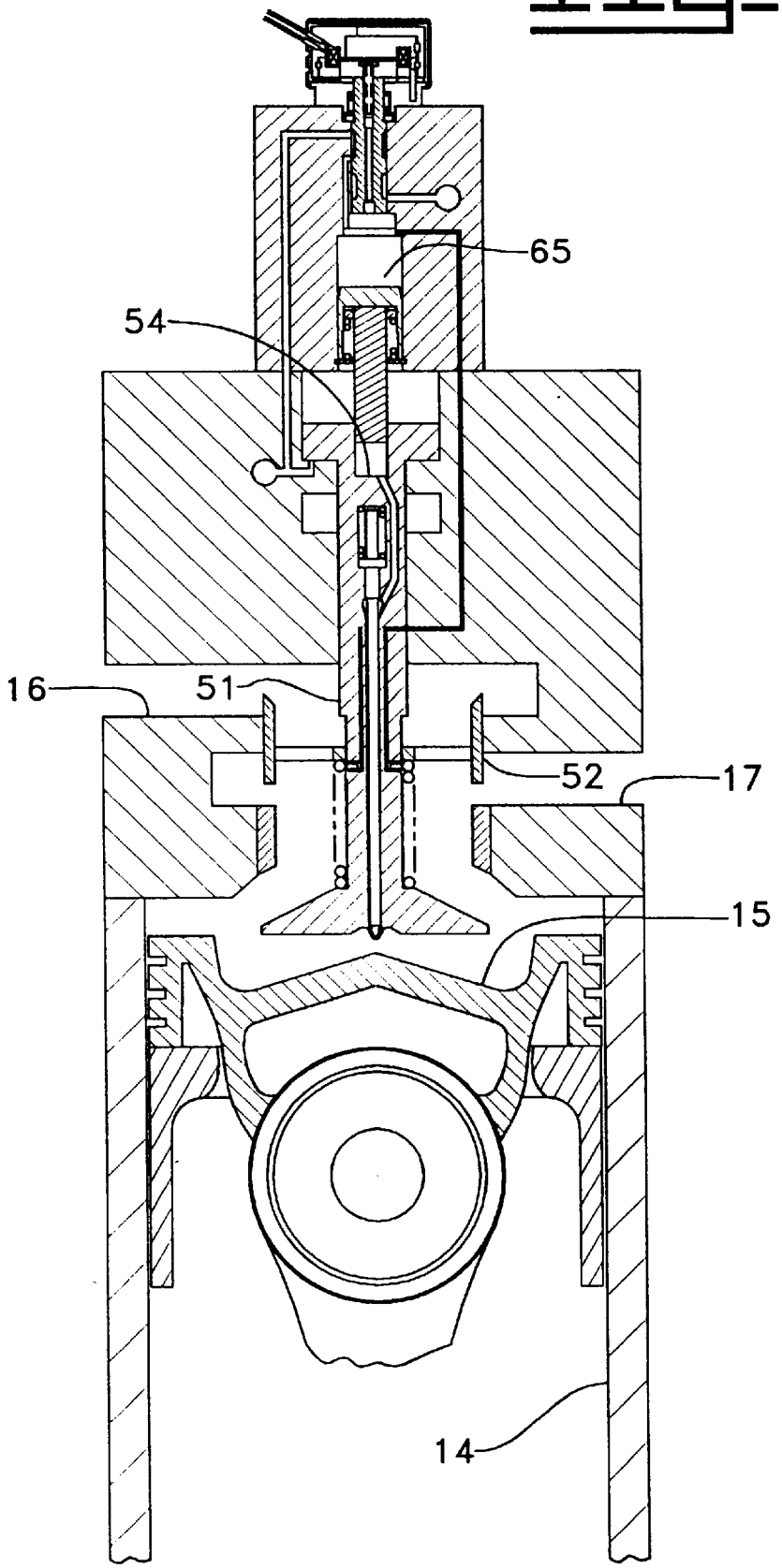
FIG. 4 is a view similar to FIG. 3 except showing the piston at top dead center when the system is moving from its exhaust to the intake portion of the engine cycle.
Figure 5:
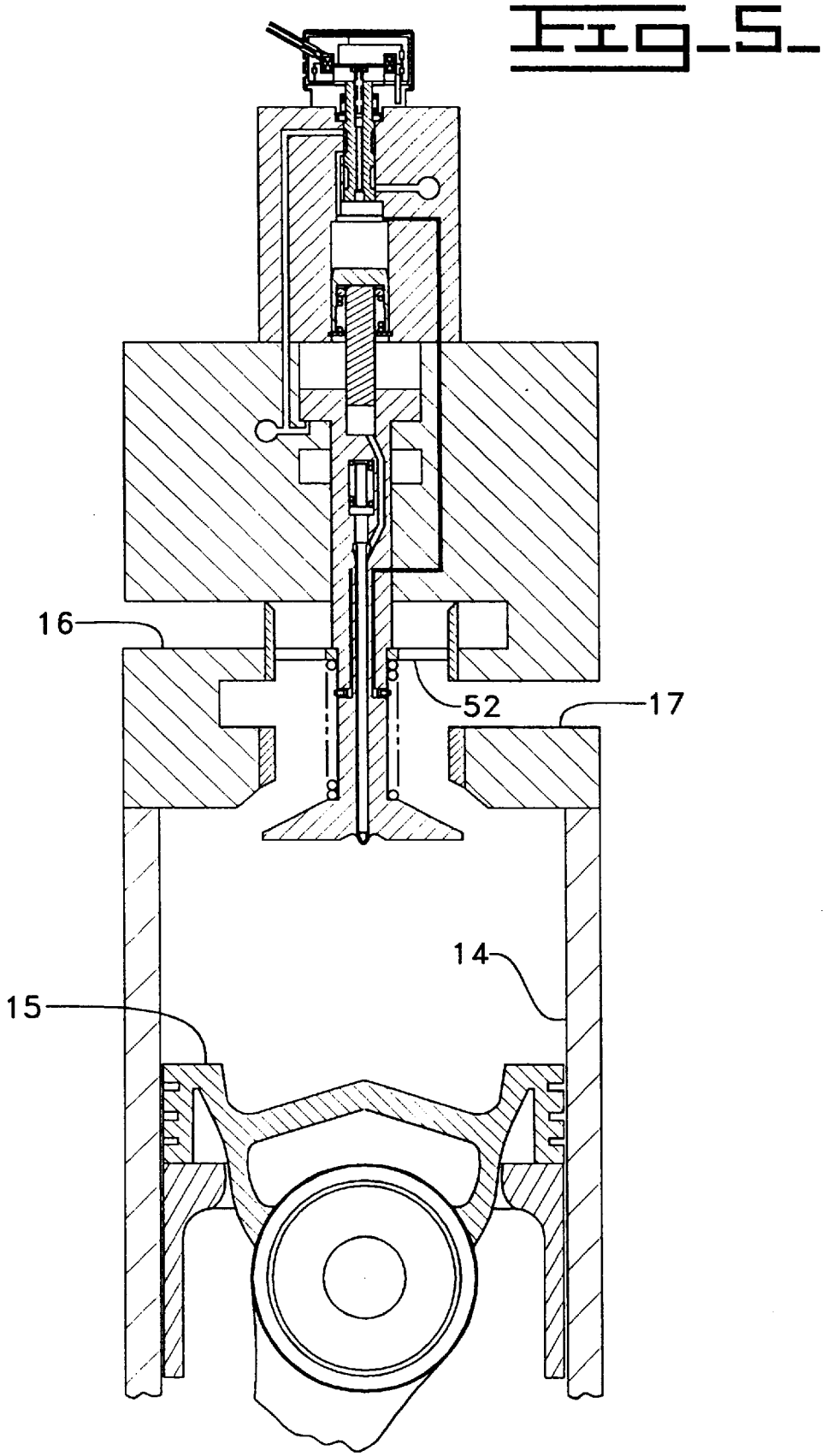
FIG. 5 is a view similar to FIGS. 3 and 4 showing the engine and fuel injection system in their intake position.

As one moves to the right in FIGS. 2*a–e*, the engine's crank shaft (not shown) continues to rotate such that piston 15 is moved upward to push burnt exhaust gases from hollow piston cylinder 14 into exhaust passage 16. When the piston is near top dead center position as shown in FIG. 4, the solenoid is briefly de-energized to allow catch pins 90 to retract under the action of return spring (catch pin(s)) to retract under the action of catch biasing spring(s) 91. This allows gas control valve member 52 to move upward under the action of biasing spring 57 from its exhaust position to its intake position. Gas valve member 51 stays near its open position because it reacts much more sluggishly compared to catch pin(s) 90. As piston 15 moves downward toward its bottom dead center position as shown in FIG. 5, air is drawn into hollow piston cavity 14 through intake passage 17. At about the time that piston 15 reaches its bottom dead center position, the solenoid is de-energized so that the gas valve member 51 moves to its biased closed position under the action of the fluid pressure acting on gas valve return shoulder 59 in cavity 53.

As the crank shaft continues to rotate, piston 15 begins its upward compression stroke from bottom dead center as shown in FIG. 6. Pressure within hollow piston cavity begins to build to a point that it is sufficient to hold gas valve member 51 in its closed position when hydraulic actuator 46 is again actuated for the injection event. FIG. 7 shows that each injection takes place at or near when piston 15 is at its top dead center position and pressure within hollow piston cavity is relatively high. At this point, the solenoid is again activated so that high pressure actuation fluid acts on top surface 67 of piston 66 to drive plunger 68 downward to pressurize fuel within fuel pressurization chamber 75. Because the gas pressure acting on closing pressure surface 84 of gas valve member 51 is relatively high, the high fuel pressure acting on opening pressure surface 54 is insufficient to move gas valve member 51 towards its open position. Instead, fuel pressure continues to rise until it reaches a valve opening pressure sufficient to move needle valve member from its blocked position to its inject position, as shown in FIG. 7. At this point, fuel commences to spray into the combustion space through nozzle outlet 80 and combustion takes place.

The injection event is ended by de-energizing the solenoid to close control valve 61 so that actuation fluid pressure on top surface 67 of intensifier piston 66 is relieved. When fluid pressure in actuation fluid cavity 65 is relieved, fuel pressure within fuel pressurization chamber 75 eventually drops below a valve closing pressure. This results in needle valve member 55 moving back to its blocked position under the action of biasing spring 79 to end the injection event. During the downward power stroke of piston 15, intensifier piston 66 and plunger 68 are reset into their respective retracted positions under the action of return spring 69. When the power stroke is completed, and the subsequent exhaust portion of the next engine cycle begins, the solenoid is again energized and high pressure actuation fluid flows into actuation fluid cavity 65 acting upon intensifier piston 66 to again pressurize fuel in fuel pressurization chamber 75. This high pressure fuel acts on opening pressure surface 54 to again move gas valve member 51 toward its open position and gas control valve member 52 to its exhaust position for the exhaust portion of the engine cycle.

The integrated fuel injector and mono cylinder valve of the present invention addresses several major problems existing in today's diesel engine designs. First of all, in the preferred embodiment both the mono valve and the fuel injector are electronically controlled so that the actuation of both subsystems can be accomplished independent of the engine's crank shaft. This enables the operation of the engine to be optimized for various operating conditions and other environmental factors. In addition, by exploiting pressure conditions existing in the hollow piston cylinder, the mono valve and the fuel injector can be operated independent of one another since their respective actuations take place during different portions of the engine's operating cycle. The mono valve design also eliminates the conflicting spacial requirements of the fuel injector and valving subsystems and eliminates the limiting affect of structural bridges between prior art valves. In other words, it allows the fuel injector to be located at an optimal central location in the combustion chamber without compromise to the porting and valve locations necessary for engine breathing. The mono valve also provides a relatively larger flow area for intake and exhaust, and thus eliminates the need for piston valve pockets and other compromises in the combustion chamber of a compression ignition diesel type engine. Those skilled in the art will appreciate that some of the advantages of the present invention can still be retained if a conventional cam actuator were substituted for the preferred hydraulic actuator illustrated in the drawings.

Those skilled in the art will appreciate the numerous modifications and alternative embodiments of the present invention will be apparent in view of the foregoing description. For instance, the present invention could be modified for a two cycle free piston or crank shaft type engine by eliminating the gas control valve member, the system could be modified to a cam actuated system as discussed earlier, or the present invention could be incorporated into one or more valves of a multi valve engine system. Accordingly, the above description is to be construed as illustrative only, and is for the purpose of teaching those skilled in the art the best mode of carrying out the invention. The details of the structure may be varied substantially without departing from the spirit of the invention, the scope of which is defined in terms of the claims as set forth below.

We claim:

1. An engine comprising:

an engine casing defining a hollow piston cavity separated from a gas passageway by a valve seat;

a gas valve member positioned adjacent said valve seat and being movable between an open position at which a portion of said gas valve member is away from said valve seat, and a closed position at which said portion is seated against said valve seat;

said gas valve member defining a nozzle outlet that opens directly into said hollow piston cavity;

an electronically controlled actuator coupled to said gas valve member; and a needle valve member positioned in said gas valve member and being movable between an inject position at which said nozzle outlet is open, and a blocked position at which said nozzle outlet is blocked.

2. The engine of claim 1 wherein said hollow piston cavity has a centerline; and said valve seat is a single valve seat that surrounds said centerline.

3. The engine of claim 1 wherein said electronically controlled actuator is a hydraulic actuator.

4. An engine comprising:

an engine casing defining a hollow piston cavity separated from a gas passageway by a valve seat;

a gas valve member positioned adjacent said valve seat and being movable between an open position at which a portion of said gas valve member is away from said valve seat, and a closed position at which said portion is seated against said valve seat;

said gas valve member defining a nozzle outlet that opens directly into said hollow piston cavity;

a needle valve member positioned in said gas valve member and being movable between an inject position at which said nozzle outlet is open, and a blocked position at which said nozzle outlet is blocked;

said gas passageway opening to an intake passage and an exhaust passage; and a gas control valve being movable between an exhaust position at which said intake passage is closed to said gas passageway, and an intake position at which said exhaust passage is closed to said gas passageway.

5. The engine of claim 1 having a cycle that includes an intake portion, an injection portion, a power portion and an exhaust portion;

said gas valve member being at said open position and said needle valve member being at said blocked position during said intake portion of said cycle;

said gas valve member being at said closed position and said needle valve member being at said inject position when in said injection portion of said cycle;

said gas valve member being at said closed position and said needle valve member being at said blocked position during said power portion of said cycle; and said gas valve member being at said open position and said needle valve member being at said blocked position when in said exhaust portion of said cycle.

6. An engine comprising:

an engine casing defining a hollow piston cavity separated from a gas passageway by a valve seat;

a gas valve member positioned adjacent said valve seat and being movable between an open position at which a portion of said gas valve member is away from said valve seat, and a closed position at which said portion is seated against said valve seat;

said gas valve member defining a nozzle outlet that opens directly into said hollow piston cavity;

a needle valve member positioned in said gas valve member and being movable between an inject position at which said nozzle outlet is open, and a blocked position at which said nozzle outlet is blocked;

said gas valve member being a portion of an injector body that defines a fuel pressurization chamber that opens to said nozzle outlet;

said needle valve member having a lifting hydraulic surface exposed to fluid pressure in said fuel pressurization chamber; and said gas valve member having a closing pressure surface exposed to fluid pressure in said hollow piston cavity, and an opening pressure surface exposed to fluid pressure in said fuel pressurization chamber.

7. The engine of claim 6 wherein said fuel pressurization chamber cycles between a relatively low fuel pressure and a relatively high injection pressure during each engine cycle, and a valve opening pressure lies between said relatively low fuel pressure and said relatively high injection pressure;

said hollow piston cavity cycles between a relatively high compression pressure and a relatively low gas exchange pressure during each engine cycle;

said lifting hydraulic surface, said closing pressure surface and said opening pressure surface are sized relative to one another in a relation that is dependent upon said relatively high compression pressure, said relatively low gas exchange pressure and a valve opening pressure.

8. An engine comprising:

an engine casing defining a hollow piston cavity separated from a gas passageway by a valve seat;

a gas valve member positioned adjacent said valve seat and being movable between an open position at which a portion of said gas valve member is away from said valve seat, and a closed position at which said portion is seated against said valve seat;

said gas valve member defining a nozzle outlet that opens directly into said hollow piston cavity;

an electronically controlled hydraulic actuator coupled to said gas valve member;

a needle valve member positioned in said gas valve member and being movable between an inject position at which said nozzle outlet is open, and a blocked position at which said nozzle outlet is blocked;

a hydraulic actuator being coupled to said gas valve member; and said hydraulic actuator being connected to a source of actuation fluid that is different from fuel.

9. A fuel injection system comprising:

a fuel injector having a needle valve member, an actuator electronically controlled and an injector body defining a fuel pressurization chamber that opens to a nozzle outlet;

said needle valve member being positioned in said injector body and moveable between an inject position at which said fuel pressurization chamber is open to said nozzle outlet, and a blocked position at which said fuel pressurization chamber is blocked to said nozzle outlet; and a portion of said injector body adjacent said nozzle outlet being a gas valve member.

10. The fuel injection system of claim 9 wherein said fuel injector defines a fuel inlet and an actuation fluid inlet;

said fuel inlet being connected to a source of relatively low pressure fuel fluid; and said actuation fluid inlet being connected to a source of relatively high pressure actuation fluid that is different from said fuel fluid.

11. The fuel injection system of claim 9 wherein said fuel injector has a centerline; and said gas valve member is coupled to said electronically controlled actuator and has a valve surface that surrounds said centerline.

12. A fuel injection system comprising:

a fuel injector having a needle valve member, an actuator and an injector body defining a fuel pressurization chamber that opens to a nozzle outlet;

said needle valve member being positioned in said injector body and moveable between an inject position at which said fuel pressurization chamber is open to said nozzle outlet, and a blocked position at which said fuel pressurization chamber is blocked to said nozzle outlet;

a portion of said injector body adjacent said nozzle outlet being a gas valve member;

said gas valve member having a stem portion extending along a centerline; and a gas control valve member being mounted on said stem portion and being moveable along said centerline between an intake position and an exhaust position.

13. The fuel injection system of claim 9 wherein said gas valve member is moveable with respect to another portion of said injector body between an open position and a closed position; and said actuator is hydraulically powered and coupled to said gas valve member.

14. A fuel injection system comprising:

a fuel injector having a needle valve member, an actuator and an injector body defining a fuel pressurization chamber that opens to a nozzle outlet;

said needle valve member being positioned in said injector body and moveable between an inject position at which said fuel pressurization chamber is open to said nozzle outlet, and a blocked position at which said fuel pressurization chamber is blocked to said nozzle outlet;

a portion of said injector body adjacent said nozzle outlet being a gas valve member;

a needle biasing spring being positioned to bias said needle valve member toward said blocked position;

said needle valve member having a lifting hydraulic surface exposed to fluid pressure in said fuel pressurization chamber; and said gas valve member having a closing pressure surface exposed to fluid pressure outside of said injector body, and an opening pressure surface exposed to fluid pressure in said injector body.

15. The fuel injection system of claim 14 wherein said lifting hydraulic surface, said closing pressure surface and said opening pressure surface are sized relative to one another.

16. An integrated fuel injector and cylinder valve for an engine comprising:

an injector body defining an actuation fluid cavity, an actuation fluid inlet, a fuel pressurization chamber and a nozzle outlet;

a portion of said injector body being a gas valve member that is moveable with respect to a remaining portion of said injector body between an open position and a closed position, and said gas valve member having an opening pressure surface exposed to fluid pressure within said injector body and a closing pressure surface exposed to fluid pressure outside of said injector body; and a needle valve member positioned in said injector body and being moveable between an inject position at which said fuel pressurization chamber is open to said nozzle outlet, and a blocked position at which said fuel pressurization chamber is blocked to said nozzle outlet.

17. The integrated fuel injector and cylinder valve of claim 16 wherein said injector body further defines a plunger bore;

a plunger positioned in said plunger bore and being moveable between an advanced position and a retracted position; and said fuel pressurization chamber being defined by a portion of said plunger bore, said plunger and said opening pressure surface of said gas valve member.

18. The integrated fuel injector and cylinder valve of claim 16 wherein said injector body further defines a piston bore;

a piston with an end hydraulic surface exposed to fluid pressure in said actuation fluid cavity and being positioned in said piston bore and being moveable between a retracted position and an advanced position; and when said piston moves from said retracted position toward said advanced position one of either said gas valve member is hydraulically pushed toward said open position or said needle valve member is lifted toward said inject position.

19. The integrated fuel injector and cylinder valve of claim 16 wherein said needle valve member has a lifting hydraulic surface exposed to fluid pressure in said fuel pressurization chamber;

said lifting hydraulic surface, said closing pressure surface and said opening pressure surface are sized relative to one another.

20. The integrated fuel injector and cylinder valve of claim 16 further comprising a control valve attached to said injector body and having a first position at which said actuation fluid inlet is open to said actuation fluid cavity, and a second position at which said actuation fluid inlet is closed to said actuation fluid cavity.

* * * * *